United States Patent [19]

Schultz

[11] 4,437,774

[45] Mar. 20, 1984

[54] DRILLING BIT BEARINGS

[76] Inventor: Daryl A. Schultz, R.R. 2, Box 92-A, Rensselaer, Ind. 47979

[21] Appl. No.: 392,992

[22] Filed: Jun. 28, 1982

[51] Int. Cl.[3] ..... F16C 19/28

[52] U.S. Cl. ..... 384/92; 308/183

[58] Field of Search ..... 384/92, 95, 96; 308/183, 174; 175/372

[56] References Cited

U.S. PATENT DOCUMENTS

| | | | |
|---|---|---|---|
| 1,494,695 | 5/1924 | McCluskey | 308/183 |
| 1,914,226 | 6/1933 | Wettlaufer | 308/183 |
| 3,601,456 | 8/1971 | Becker | 384/92 |
| 4,133,587 | 1/1979 | Kume | 308/183 |

*Primary Examiner*—Lenard A. Footland

*Attorney, Agent, or Firm*—Beveridge, DeGrandi and Kline

[57] ABSTRACT

An improved drilling bit has a cone shaped cutter 22 rotatably mounted on a leg 16 by way of a central journal 18 and an annular journal 20. The annular journal is axially coextensive with the central journal. The cutter has outer collar 26 and inner collar 28 which interfit with the journals to provide a large surface area for roller bearings 30, 36 and 42. Additionally, the cutter may have a post 68 within cavity 70 on the terminal and of the central journal 18 so that roller bearings 74 can be provided to further increase the area of roller bearings handling radial loads. This increases the lifetime of the bit assembly. Ball bearings 50, 52, 66 and 72 are provided to handle axial loads, and ball bearings 54 are provided to retain the cutter on leg 16.

10 Claims, 3 Drawing Figures

DRILLING BIT BEARINGS

BACKGROUND OF THE INVENTION

The present invention relates to improvements in drilling bits for use in drilling wells in the ground, such as water wells or oil wells.

Conventional drill bits are made of a plurality of sectional body parts together making up a circular bit assembly. Each body part has a cutter rotatably mounted thereon, with the axis of rotation oriented toward the center of the bit assembly. As the bit assembly is rotated, the individual cutters rotate on their respective body parts to scour and loosen the earth.

Various bit assemblies have been devised, as indicated by the following U.S. patents:

U.S. Pat. No. 2,011,084 to F. L. Scott;
U.S. Pat. No. 2,154,032 to A. C. Catland;
U.S. Pat. No. 2,297,192 to C. E. Reed;
U.S. Pat. No. 2,351,357 to E. L. Miller et al.;
U.S. Pat. No. 2,470,695 to J. S. Goodwin et al.;
U.S. Pat. No. 3,095,934 to R. E. Goetz;
U.S. Pat. No. 3,950,041 to R. A. Miglierini;
U.S. Pat. No. 4,298,079 to G. Norlander et al.

These patents disclose various bearing assemblies which are intended to handle the frictional forces developed in the bit during drilling. The frictional forces have two force components acting on the bit. Axial components are usually handled by ball bearings, and radial components are usually handled by roller bearings. The radial force components are generally quite large because the net downward movement of the drill into the ground is resolved substantially entirely into a radial force on each body part and cutter assembly.

The radial forces are so large that excessive wear of the roller bearings is a major cause of early bit failure. Often the bearings are worn to the point that the cutter falls off of the body part while in the hole in the ground, although the teeth of the cutter still have a substantial useful life. As a result it has been necessary to remove the entire drilling assembly, fish the cutter out of the hole, reassemble the bit, and then reinsert the drilling assembly before drilling can continue. This substantial downtime is costly.

SUMMARY OF THE INVENTION

Accordingly, there is a need in the art for an improved drill bit assembly which will overcome problems of early bit failure caused by excessively worn bearings.

The present invention fulfills this need by providing a drilling bit which includes a frame having a leg, which has a central journal and an annular journal concentric with, radially outward of, and axially coextensive with the central journal, the central journal having an outer face and the annular journal having inner and outer faces, a cutter rotatably mounted on the leg having an outer collar with an inner face located outward of the annular journal and an inner collar with inner and outer faces disposed between the central and annular journals, an outer bearing means between the inner face of the outer collar and the outer face of the annular journal, an intermediate bearing means between the inner face of the annular journal and the outer face of the inner collar, and an inner bearing means between the inner face of the inner collar and the outer face of the central journal.

Preferably, the central journal has a terminal end with a cavity therein having a radial inner face, the cutter has an opening receiving the terminal end of the central journal, and has formed centrally in the opening a post with an outer face extending into the cavity, and a distal bearing means is provided between the inner face of the cavity and the outer face of the post.

The central journal and the opening in the cutter have opposed axial faces and ball bearings are provided in cooperating races formed on these axial faces. The cavity and the post have opposed axial faces and ball bearings are provided in cooperating races formed on their axial faces. Preferably the outer, intermediate, inner and distal bearing means are roller bearings. Ball bearings are provided in cooperating races formed on the leg and the end of the inner collar of the cutter. Additional ball bearings are provided in cooperating races formed on the cutter and the end of the annular journal.

The cutter has an opening receiving the central journal, the opening has a radially inwardly facing interior face opposed to the outer face of the central journal and ball bearings are provided in cooperating races formed on the outer face of the central journal and on the interior face of the opening. A hole is formed from the outside of the leg through the central journal to the race formed on the outer face of the central journal, the hole being of a size to receive the ball bearings provided in the race, and a plug substantially fills the hole.

BRIEF DESCRIPTION OF THE DRAWINGS

The invention will be better understood by a reading of the detailed description hereinafter, along with a study of the drawings in which.

DETAILED DESCRIPTION OF THE PREFERRED EMBODIMENT

Figure 1:
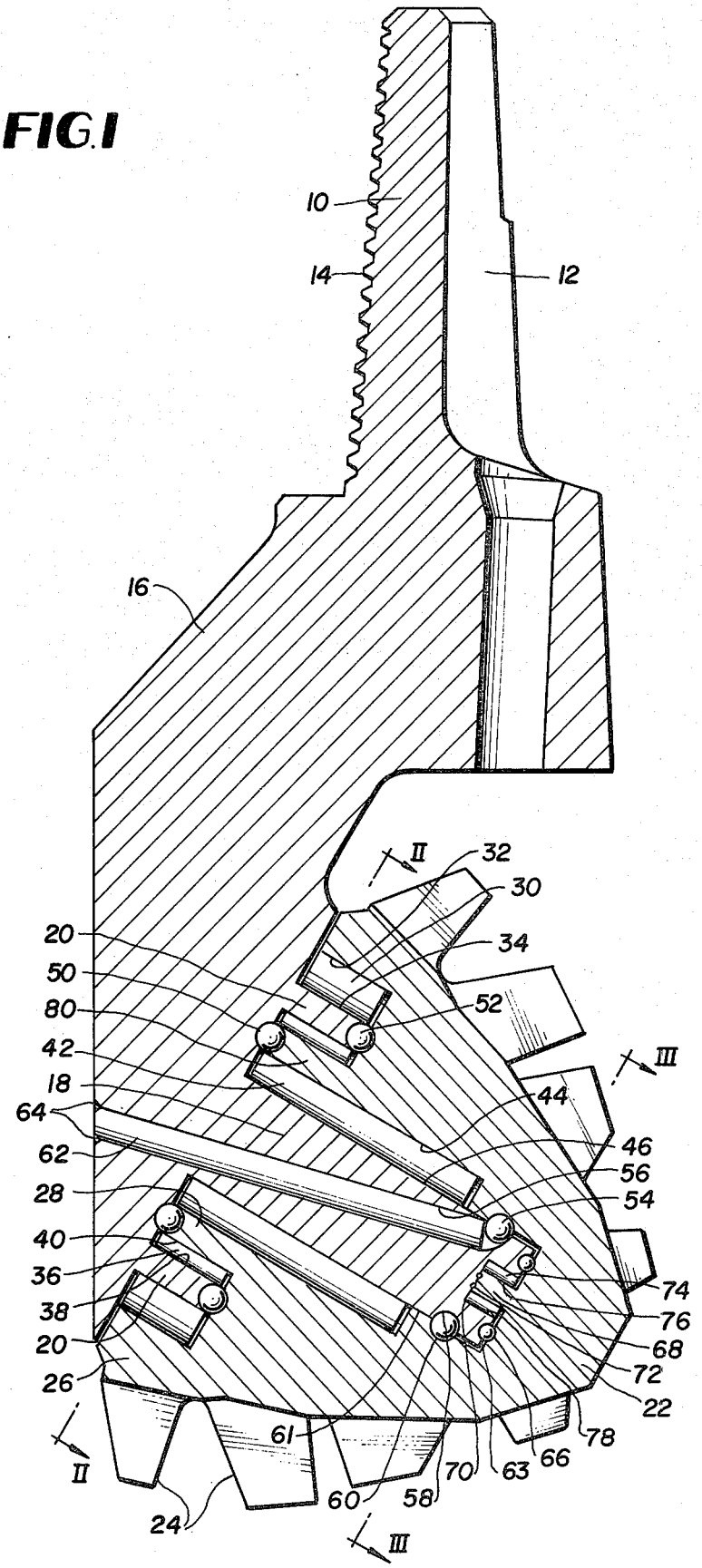
FIG. 1 is a sectional view of one leg of a multiple leg drill bit assembly and cutter cone thereon.

The improved bit is made up of a plurality of body parts 10 each of which has an upwardly extending stem portion 12 that can be externally threaded as at 14 for attachment with additional body parts 10 to a drill collar at the lower end of a well drilling string. Each frame or body part 10 has a downwardly extending leg 16.

In a typical drilling rig, there will be three identical body parts 10, however, the number of body parts can vary, as will be apparent to those of ordinary skill.

Each leg 16 has a central journal 18 and an annular journal 20. Annular journal 20 is concentric with, radially outward of, and axially coextensive with central journal 18. Rotatably mounted on leg 16 is a generally cone-shaped cutter 22 having teeth 24. The teeth can be of any desired number, shape, and arrangement. The cutter 22 has an outer collar 26 outward of the annular journal 20 and an inner collar 28 disposed between the central journal 18 and the annular journal 20. In the embodiment shown in FIG. 1, central journal 18 is considerably longer than annular journal 20, but the relative lengths thereof can be varied, in accordance with the shape of the cutter 22.

One of the significant features of the present invention is made possible by the provision of axially coextensive journals. As used herein the term "axially coextensive journals" means at least two journals on which a single rotatable body can rotate about a single axis, having at least portions thereof at the same position axially, but at different positions radially. Thus there are two axially coextensive journals in the plane of FIG. 2.

Figure 2:
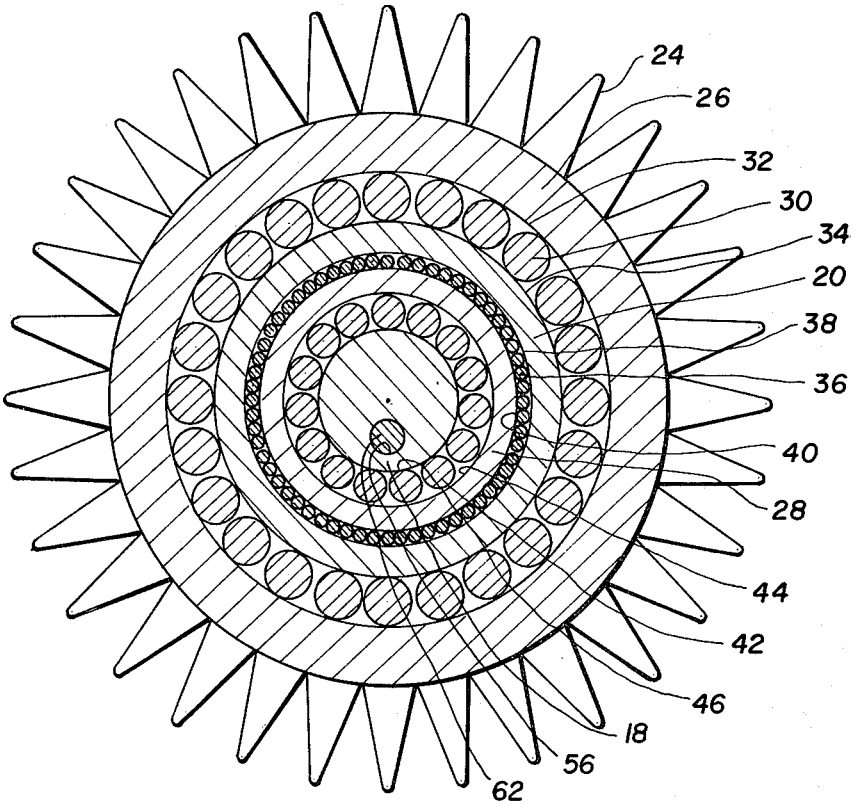
FIG. 2 is a sectional view of the bit assembly of FIG. 1 taken along lines II—II, looking in the direction of the arrows.

Three sets of roller bearings are provided in the plane of FIG. 2 to absorb the radial loads between cutter 22 and journals 18 and 20 during drilling operations. Outer roller bearings 30 are located between inner face 32 of outer collar 26 and outer face 34 of annular journal 20. Intermediate roller bearings 36 are located between inner face 38 of annular journal 20 and outer face 40 of inner collar 28. Inner roller bearings 42 are located between inner face 44 of inner collar 28 and outer face 46 of central journal 18. It is desirable that the bearings be as long as possible in order to maximize the bearing surface available to handle radial loads. Thus inner roller bearing 42 extends past the junction 80 of inner collar 28 with the remainder of cutter 22 for a substantial distance.

To handle axial forces acting between cutter 22 and leg 16, a proximate set of ball bearings 50 and a distal set of ball bearings 52 are disposed in cooperating races formed on the leg and cutter.

The cutter 22 is retained on leg 16 by a third set of ball bearings 54. A hole 56 is drilled from the outside of the leg 16 and through the central journal 18, terminating on the inner race 58 formed on the outer face 46 of journal 18. Inner race 58 cooperates with outer race 60 formed on the interior 61 of cutter 22. To assemble the bit assembly, ball bearings 54 are inserted through hole 56, after which ball plug 62 is inserted in the hole 56. Plug 62 is welded in place such as by weld 64. Ball plug 62 has its inner end shaped to conform to the inner race 58 formed on the journal 18.

In one embodiment the central journal 18 can be merely provided at its terminal end with a fourth set of ball bearings 66 in cooperating races formed on the axial face of the terminal end of the central journal and on the axial face of opening 63 in the cutter. However, it is preferred to provide yet another roller bearing assembly, as shown in FIG. 1.

Figure 3:
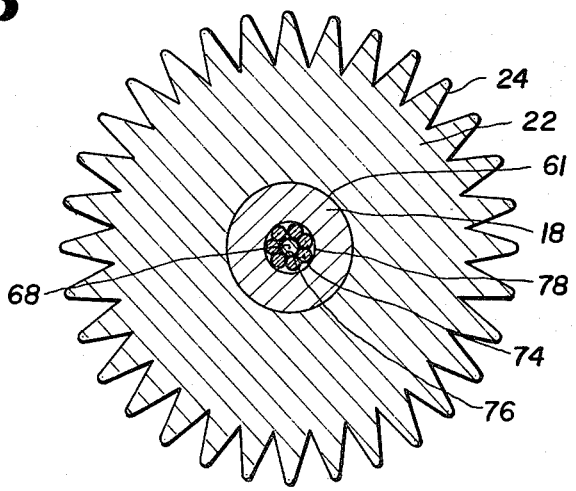
FIG. 3 is a sectional view of the assembly of FIG. 1, taken along lines III—III, looking in the direction of the arrows.

In this case the opening 63 of the cutter has centrally formed thereon a post 68 and the central journal 18 has a cavity 70 in its terminal end. A fifth set of ball bearings 72 are provided in cooperating races formed in the opposed axial faces of cavity 70 and post 68. Radial forces between the outer face 76 of post 68 and the inner face 78 of cavity 70 are taken by distal roller bearings 74. The arrangement of the roller bearing assembly can be seen in FIG. 3.

Thus in the preferred embodiment four roller bearing assemblies are provided. As a result the radial forces are distributed over a large bearing area, so that no single bearing wears at an excessively high rate. If the bit assembly is not manufactured to precise tolerances, one bearing may initially carry a greater load than the other. However, It will wear faster than the lesser-loaded bearings until the loads on the respective bearings have equalized. The load will then be more evenly distributed.

It will be apparent that through the provision of a great number of roller bearings, made possible by location thereof along axially coextensive journals, the lifetime of bearings, and thence the bit assembly, will be greatly increased.

What is claimed is:

1. A drilling bit comprising a frame having a leg said leg having a central journal and an annular journal concentric with, radially outward of, and axially coextensive with said central journal, said central journal having an outer face and said annular journal having inner and outer faces, a cutter rotatably mounted on said leg having an outer collar with an inner face located outward of said annular journal and an inner collar with inner and outer faces disposed between said central and annular journals, an outer bearing means between said inner face of said outer collar and said outer face of said annular journal, an intermediate bearing means between said inner face of said annular journal and said outer face of said inner collar, and an inner bearing means between said inner face of said inner collar and said outer face of said central journal.

2. A bit as claimed in claim 1, wherein said central journal has a terminal end with a cavity therein having a radial inner face, said cutter has an opening receiving said terminal end of said central journal, and has formed centrally in said opening a post with an outer face, said post extending into said cavity, and a distal bearing means is provided between said inner face of said cavity and said outer face of said post.

3. A bit as claimed in claim 2 wherein said outer, intermediate, inner, and distal bearing means are roller bearings.

4. A bit as claimed in claim 2 wherein said central journal and said opening in said cutter have opposed axial faces and ball bearings are provided in cooperating races formed on said axial faces.

5. A bit as claimed in claim 2 wherein said cavity and said post have opposed axial faces and ball bearings are provided in cooperating races formed on said axial faces.

6. A bit as claimed in claim 1 wherein ball bearings are provided in cooperating races formed on said leg and the end of said inner collar of said cutter.

7. A bit as claimed in claim 1 wherein ball bearings are provided in cooperating races formed on said cutter and the end of said annular journal.

8. A bit as claimed in claim 1 wherein said cutter has an opening receiving said central journal, said opening having a radially inwardly facing interior face opposed to said outer face of said central journal and wherein ball bearings are provided in cooperating races formed on said outer face of said central journal and on said interior face of said opening.

9. A bit as claimed in claim 8 wherein a hole is formed from the outside of said leg through said central journal to said race formed on said outer face of said central journal, said hole being of a size to receive said ball bearings provided in said race, and a plug substantially fills said hole.

10. A drilling bit comprising a frame having a leg said leg having a central journal and an annular journal concentric with, radially outward of, and axially coextensive with said central journal, said central journal having an outer face and an axial face, said axial face having a cavity, said cavity having an inner face and an axial face, and said annular journal having inner and outer faces, a cutter rotatably mounted on said leg having an outer collar with an inner face located outward of said annular journal, an inner collar with inner and outer faces disposed between said central and annular journals, and an opening receiving said terminal end of said central journal, with an interior face opposed to said outer face of said central journal and an axial face opposed to said axial face of said central journal, said opening having a post with an outer face and an axial face formed centrally thereon, outer roller bearings between said inner face of said outer collar and said outer face of said annular journal, intermediate roller bearings between said inner face of said annular journal and said outer face of said inner collar, and inner roller bearings between said inner face of said inner collar and said outer face of said central journal, and distal roller bearings between said inner face of said cavity and said outer face of said post on said cutter, wherein a first set of ball bearings is provided in cooperating races formed on said leg and the end of said inner collar of said cutter, a second set of ball bearings is provided in cooperating races formed on said cutter and the end of said annular journal; a third set of ball bearings is provided in cooperating races formed on the axial face of said terminal end of said central journal radially outward of said cavity and on the axial face of said opening in said cutter, radially outward of said post formed thereon; a fourth set of ball bearings is provided in cooperating races formed in said axial face of said cavity on said central journal and on said axial face of said post formed on said cutter; a fifth set of ball bearings is provided in cooperating races formed on the outer face of said central journal and on the interior face of said cutter; and a hole is formed from the outside of said leg through said central journal to said race formed on said outer face of said central journal, said hole being of a size to receive said ball bearings provided in said race on the outer face of said central journal, and a plug substantially fills said hole.

* * * * *